United States Patent [19]

Zambrano

[11] 4,185,996

[45] Jan. 29, 1980

[54] ARSENIC AND SULFUR ELIMINATION FROM COBALTIFEROUS ORES

[75] Inventor: Adolfo R. Zambrano, Hibbing, Minn.

[73] Assignee: The Hanna Mining Company, Cleveland, Ohio

[21] Appl. No.: 877,002

[22] Filed: Feb. 13, 1978

[51] Int. Cl.[2] ..... B03D 1/00; C22B 1/02

[52] U.S. Cl. ..... 75/2; 75/1 R; 75/7; 423/88; 423/138; 423/154

[58] Field of Search ..... 75/6, 7, 8, 9, 82, 21.2, 75/1 R, 1 T; 423/87, 88, 138, 153, 154

[56] References Cited

U.S. PATENT DOCUMENTS

| | | | |
|---|---|---|---|
| 1,637,838 | 8/1927 | Simonds | 75/6 |
| 2,111,789 | 3/1938 | Kuzell | 75/21 |
| 2,526,707 | 10/1950 | Stahl et al. | 75/82 |
| 2,867,526 | 1/1959 | Heath et al. | 423/88 |
| 3,053,651 | 11/1962 | McGualey | 75/6 |

OTHER PUBLICATIONS

Remy, H. *Treatise on Inorganic Chemistry* vol. II Elsevier Publishing Co., New York, p. 368 (1956).

*Primary Examiner*—L. Dewayne Rutledge
*Assistant Examiner*—Michael L. Lewis
*Attorney, Agent, or Firm*—Maky, Renner, Otto & Boisselle

[57] ABSTRACT

A method for removing sulfur and arsenic from cobaltiferous ores and recovering an enriched cobalt product is described. The procedure involves the steps of (a) oxidizing said ore at a temperature of at least about 700° C. to reduce the sulfur content of the ore to the desired level, (b) heating said oxidized ore with a reducing agent at a temperature of at least about 700° C. to remove arsenic from the ore, and (c) recovering an enriched cobalt containing solid as the product of the process.

8 Claims, No Drawings

ARSENIC AND SULFUR ELIMINATION FROM COBALTIFEROUS ORES

BACKGROUND OF THE INVENTION

The present invention relates to a method of removing sulfur and arsenic from cobaltiferous ores, and more particularly, to a method which results in the formation of a negligible amount of undesirable arsenic sulfide and/or arsine.

Cobalt occurs naturally combined with a large number of different elements. The present invention relates to a method for treating ores which not only contain cobalt, but also significant amounts of arsenic and sulfur. Two major complex arsenic sulfide ores are arsenopyrite [(Fe,Co)AsS] and cobaltite [(Co,Fe)AsS]. A number of methods have been suggested in the prior art for removing the arsenic and sulfur from such ores. One of the older techniques for removing arsenic is to subject the ore to roasting conditions whereby the arsenic is evolved as arsenious acid, after which the ore, in one way or another, is treated further, generally by smelting. The formation of the arsenious acid is a distinct disadvantage of this method since it is extremely poisonous and is difficult to sell as a product.

Processes for vaporizing the arsenic from the ore with chlorine have been suggested and operated commercially, but these are expensive also. It is well-known that arsenic can be easily eliminated when the arsenide is smelted along with a large amount of a sulfide ore, but this results in a dilution of the cobalt with a large amount of iron and/or copper. Therefore, this technique is not very economical unless the iron and/or copper subsequently can be separated from the cobalt.

Procedures also have been described for removing arsenic and sulfur by heating the ore under reducing conditions. In this technique, however, the formation of $As_2S_3$, $As_2S_2$ and $AsH_3$ is unavoidable. The first two compounds lead to operational difficulties due to stickiness, and the third compound, arsine, is an undesirable gaseous poison that should be avoided as much as possible.

SUMMARY OF THE INVENTION

The present invention provides a method for removing arsenic and sulfur from cobalt containing ores which does not result in the formation of $As_2S_3$ or $As_2S_2$ thereby reducing stickiness problems. The method of the invention also can be utilized to remove arsenic and sulfur from the ores with a negligible amount of arsine being formed. The method of the invention comprises the steps of (a) oxidizing said ore at a temperature of at least about 700° C. to reduce the sulfur content of the ore to the desired level, (b) heating said oxidized ore with a reducing agent at a temperature of at least about 700° C. to remove arsenic from the ore, and (c) recovering an enriched cobalt containing solid as the product of the process.

DESCRIPTION OF THE PREFERRED EMBODIMENTS

While primarily concerned with the treatment of cobaltite ores and concentrates, the method of the present invention is applicable to a wide variety of ores containing cobalt, sulfur and arsenic such as arsenopyrite. Although ores can be treated with the method of the invention, the method generally is conducted on sulfide concentrates obtained from the natural ores by a bulk sulfide flotation procedure. The bulk sulfide concentrate obtained then is treated by a modified United States Bureau of Mines process which comprises a partial roasting of the concentrate at 450° C. followed by the selective flotation of the cobaltite. The cobaltite:sulfide concentrate obtained in this manner is the concentrate which is used in the examples which follow. Examples of analyses of typical cobaltite concentrates obtained in this manner are summarized in the following Table I:

TABLE I

| Concentrate | Fe | Co | As | S | Fe/As |
|---|---|---|---|---|---|
| A | 11.45 | 22.16 | 30.47 | 20.85 | 0.38 |
| B | 10.0 | 25.2 | 32.1 | 24.1 | 0.31 |
| C | 8.25 | 15.21 | 22.0 | 9.2 | 0.38 |

Cobalt ores and cobalt concentrates such as those described above are oxidized in accordance with the method of the invention by heating to a temperature of at least about 700° C. and preferably at a temperature between about 700° to 800° C. in an oxidizing atmosphere such as air. During this oxidation step, the cobaltite in the sulfide concentrate is oxidized to several cobalt and iron arsenate species such as, for example, $Co_3As_2O_8$, $Co_2As_2O_7$, $Fe_4As_2O_{11}$ and $Co_6As_2O_{11}$, and no arsine is formed in the oxidation step. In addition to the formation of the arsenate compounds, the oxidation roasting procedure significantly reduces the concentration of sulfur in the oxidized product. The oxidation of the ore concentrate is conducted for a period of time sufficient to convert the cobalt and iron to the arsenate species and to remove the desired amount of sulfur from the ore as sulfur oxides. Generally, the oxidation will be conducted for a period of time of between 3 to about 10 hours although longer periods of time may be required for individual ores to further reduce the sulfur content to a desired low level.

Upon completion of the oxidation step, the oxidized product is heated to and maintained at a temperature of at least about 700° C. in the presence of a reducing agent which results in the removal of arsenic from the oxidized ore obtained in step (a). The cobalt and iron arsenate species are reduced to cobalt oxide and the arsenous oxide which is removed as a gas. The reduction reaction is conducted at a temperature of at least about 700° C. and is preferably conducted at a temperature of between 700° and 800° C. Although the reduction can be conducted over longer or shorter periods, the reduction reaction generally is conducted for a period of from about 2 to 6 hours.

The reduction of the oxidized ore can be effected with any of the known reducing agents which may be either gaseous, liquid or solid. Suitable gaseous reducing agents for the reduction include hydrogen, hydrogen containing gas mixtures, carbon monoxide, and carbon monoxide containing gas mixtures. When the reducing agent is a gaseous material, any equipment in which contact can be effected between a gas and a solid may be used for the reduction. For example, fixed bed, moving bed and fluid bed techniques may be utilized.

The oxidized ore concentrates obtained in step a also may be reduced by heating with a solid reductant such as carbon, charcoal, coal or coke or with a solid or liquid hydrocarbon such as Bunker C fuel oil, etc. A small amount of the starting cobalt sulfide concentrate has been found to be particularly effective as a reducing agent resulting in the formation and evolution of gaseous arsenous oxide with the formation of only a negligible amount of arsenic sulfide and no arsine. The gaseous arsenous oxide can be condensed and recovered.

Although not wishing to be bound by any mechanism of reaction or formation, it is believed that the oxidation and reduction reactions proceed generally as follows:

$$12CoAsS + 33O_2 \rightarrow 4Co_3As_2O_8 + 12SO_2 + 2As_2O_5 \quad (1)$$

$$9Co_3As_2O_8 + 4CoAsS \rightarrow 31CoO + 11As_2O_3 + 4SO_2 \quad (2)$$

$$Co_3As_2O_8 + 2CO \rightarrow 3CoO + As_2O_3 + 2CO_2 \quad (3)$$

The amount of reducing agent to be used in step (b) can be determined by one skilled in the art from an analysis of the oxidized ore and from a consideration of the product desired. When solid reducing agents are mixed with the oxidized ore in the reducing furnace, the amount of solid reducing agent can be from about 5 to about 30% by weight based on the weight of the oxidized ore being treated. As mentioned above, the amount of reducing agent utilized is determined from a consideration of the nature of the ore being treated and the properties or analysis desired in the final product. For example, it often is desirable to be able to control or adjust the ratio of iron to arsenic in the product to provide a ratio which will result in the precipitation of a maximum amount of ferric arsenate without the need for additional chemical additives when the reduced product is leached with an acid solution. The ideal and optimum iron to arsenic ratio is believed to be 0.75 although the presence of additional arsenic may be desirable since it may not be completely soluble. In other situations, it may be desirable to have a ratio lower than 0.75 such as, for example, when it is desirable to have some arsenic in the final product.

The following examples illustrate the method of the invention. Unless otherwise indicated, all parts and percentages are by weight.

EXAMPLE 1

The sulfide concentrate used in this example is the concentrate identified as A in Table 1 which is a cobaltite concentrate obtained from the Blackbird Creek district in Idaho, and which was subjected to a partial roasting at 450° C. followed by a selective flotation to recover the cobaltite:sulfide concentrate. The first stage roasting for sulfur removal is conducted in a 4-inch fluid bed reactor at 750° C. at a freeboard velocity of about 1 to 1.3 ft/seconds. The residence time in the reactor is about 6 hours. A typical analysis of the recovered oxidized product is as follows: iron, 11.93%, cobalt, 20.65%, arsenic, 27.38%, sulfur, 0.12%, and iron to arsenic ratio of 0.43.

The second stage reduction reaction (or roasting reaction under reducing conditions) for the elimination of arsenic also is conducted in a 4-inch fluid bed reactor utilizing 10% by weight of the sulfide concentrate (based on the weight of the oxidized ore) as a reductant. The residence time in the reactor maintained at about 750° C. is about 3.5 hours. A typical analysis of the product of the reducing reaction is as follows: iron, 14.67%, cobalt, 25.9% arsenic, 16.29%, sulfur, 0.08%; and iron/arsenic ratio 0.9.

EXAMPLE 2

The procedure of Example 1 is repeated except that only 8% by weight of the cobalt:sulfide concentrate is used as a reducing agent. The product obtained in this manner has the following analysis: iron, 13.97%; cobalt, 31.85%; arsenic, 13.95%; sulfur, 0.42%.

EXAMPLE 3

The procedure of Example 1 is repeated except that 25% by weight of the cobalt:sulfide concentrate is used as a reducing agent in the reducing reaction. The product obtained in this manner has the following typical analysis: iron, 19.17%; cobalt, 30.3%; arsenic, 6.2%; sulfur, 2.06%; and iron/arsenic ratio 3.09.

EXAMPLE 4

The procedure of Example 1 is repeated except that the reducing agent used in the second step is a carbon monoxide:carbon dioxide mixture containing 37.5% CO, and the gas space velocity is between about 1 and 1.5 ft/sec. at about 750° C. The product of this example has the following typical analysis: iron, 14.34%; cobalt, 27.4%; arsenic, 17.8%; sulfur, 0.04%; and iron/arsenic rato of 0.81.

The method of the invention as illustrated above, particularly when utilizing the cobalt:sulfide concentrate as the reducing agent in the second step, provides a method for removing sulfur and arsenic which is controlled easily, avoids the formation of arsenic sulfide and arsine and results in the formation of acid soluble species in the reduced product. Accordingly, removal of the cobalt and remaining arsenic from the reduced ore easily can be accomplished with a variety of acid leaching agents such as hydrochloric acid, nitric acid, etc.

To illustrate the high solubility of the reduced product obtained through the method of the invention, the product obtained from Example 1 is leached at 100° C. for 3 hours with a 2 N hydrochloric acid solution. Analysis of the extract indicates an extraction efficiency of 67.3% of iron, 99.7% of the cobalt and 98.6% of the arsenic present in the solid product.

What is claimed is:

1. A method for removing sulfur and arsenic from cobaltiferous ores and recovering an enriched cobalt product comprising the steps of (a) oxidizing said ore in the presence of air at a temperature of about 700° C. to 800° C. for a period of 3 to 8 hours to reduce the sulfur content of the ore, (b) heating said oxidized ore with a reducing agent at a temperature of at least about 700° C. to remove arsenic from the ore, and (c) recovering a solid enriched in cobalt.

2. The method of claim 1 wherein the oxidized ore is heated in step (b) at a temperature of from about 700°-800° C. for a period of from 2 to about 6 hours.

3. The method of claim 1 wherein the reducing agent comprises a small amount of a concentrate of the cobaltiferous ore.

4. The method of claim 3 wherein from about 3 to about 20% of the cobaltiferous ore concentrate is used as a reducing agent.

5. The method of claim 1 wherein the reducing agent is a reducing gas.

6. The method of claim 1 wherein the ore which is oxidized in step (a) is an ore concentrate obtained by partial roasting of the ore at a temperature of about 450° C. followed by the selective flotation of the cobaltite:-sulfide concentrate from the roasted ore.

7. The method of claim 1 wherein the cobaltiferous ore is cobaltite.

8. The method of claim 1 wherein the ore is heated in step (b) at a temperature of about 700° C. to 800° C.

* * * * *